US005100181A

United States Patent [19]

Nathans et al.

[11] Patent Number: 5,100,181

[45] Date of Patent: Mar. 31, 1992

[54] LOW COST LAMINATABLE PLASTIC ENVELOPE FOR EASY CUSTOMIZED SELF-LAMINATION OF GREETING CARDS, MEMORABILIA, AND LIKE DISPLAYS

[75] Inventors: Robert L. Nathans, Billerica; Roger J. Kuhns, Lincoln, both of Mass.

[73] Assignee: Avant Incorporated, W. Concord, Mass.

[21] Appl. No.: 726,272

[22] Filed: Jul. 5, 1991

Related U.S. Application Data

[63] Continuation-in-part of Ser. No. 529,138, May 14, 1991, Pat. No. 5,042,843.

[51] Int. Cl.[5] ..... B42D 3/00; B42D 15/00; B41L 1/00

[52] U.S. Cl. ..... 283/109; 281/29; 281/35; 281/31; 283/79; 283/107; 283/117; 428/203; 428/204; 462/84

[58] Field of Search ..... 281/15.1, 29, 31, 35, 281/37; 462/6, 7, 84; 283/72, 79, 80, 81, 107, 109, 117; 428/203, 204, 205, 211, 212, 218

[56] References Cited

U.S. PATENT DOCUMENTS

| | | | |
|---|---|---|---|
| 4,121,856 | 10/1978 | Brunette | 283/81 X |
| 4,121,961 | 10/1978 | Brunette et al. | 283/81 X |
| 4,386,795 | 6/1983 | Charles et al. | 283/81 X |
| 4,407,524 | 10/1983 | Trautlein | 283/79 X |
| 4,496,961 | 1/1985 | Devrient | 283/72 X |
| 4,892,335 | 1/1990 | Taft | 283/109 X |
| 4,932,681 | 6/1990 | Wörndli | 283/72 X |
| 4,951,970 | 8/1990 | Burt | 283/79 X |
| 4,971,361 | 11/1990 | Whiting | 281/15.1 X |

*Primary Examiner*—Paul A. Bell
*Attorney, Agent, or Firm*—Robert L. Nathans

[57] ABSTRACT

Memorabilia insert sheets are pressed against a support sheet having rows and columns of small area self-stick visual fiducial adhesive zones imprinted thereon. Since the adhesive in the zones is releasable and reusable, misaligned insert sheets may be readily mounted upon the support sheet a number of times by an unskilled user until the insert sheet edges are parallel with respect to the support sheet edges and the surrounding borders are even. A transparent cover sheet is then laminated to the insert sheet by the application of heat and pressure to make a long-lasting, attractive display.

26 Claims, 1 Drawing Sheet

LOW COST LAMINATABLE PLASTIC ENVELOPE FOR EASY CUSTOMIZED SELF-LAMINATION OF GREETING CARDS, MEMORABILIA, AND LIKE DISPLAYS

This is a continuation-in-part of U.S. patent application Ser. No. 07/529,138, filed May 14, 1991 in the name of Roger J. Kuhns et al. and assigned to Avant Incorporated, now U.S. Pat. No. 5042,843.

BACKGROUND OF THE INVENTION

The present invention relates to the field of laminated plastic display devices such as ID cards, sales presentation folders, memorabilia displays, greeting cards and the like.

In our somewhat mechanized and impersonal society, people have a need for self-expression. For example, conventional greeting cards although mass-marketed, lack the personal touch for many. People buy substitute "liscense plate" posters mounted on the front of their cars for self-expression but the messages and designs are limited in number and, like greeting cards, are not really customized. The need for self expression is partially satisfied by collecting memorabilia such as photos, nostalgic invitations, matchbook covers, post cards, newspaper clippings, theater tickets and the like. Such memorabilia is usually stored in file folders, albums or other containers where they are not continuously viewed, and hence often forgotten. They are also often unprotected against dampness and can be marred during handling by the collector.

Other types of memorabilia which are fun to produce, are PC generated imagery, customized with the aid of "desk-top" publishing programs. Examples are pictures of the family, pets, the family house and car and so forth. Such customized pictures may be comical by, for instance, putting eye-glasses on ones dog or cat. As in the case of the aforesaid memorabilia, it is desirable to continuously display and preserve this type of somewhat fragile computer output, which would be fun to laminate upon a customized greeting card, wall display or in the license plate format mentioned above.

It is believed that this need for self-expression may be fulfilled by providing people with a method of self-laminating such memorabilia on the spot, without sending the material to a mail order laminating facility, to create customized visual displays for continuous viewing. Lamination of such material within a plastic envelope also preserves the memorabilia indefinitely and greatly improves the aesthetic appearance thereof. The desired do-it-yourself self-laminating process should be quick and easy to carry out on-the-spot, by any unskilled person. Optionally, it would be desirable to provide a method of lamination not requiring a conventional laminator at all, although a conventional laminator could produce a better lamination.

Furthermore, even conventional laminating equipment, often results in the production of a laminated product having skewed, unaesthetically positioned or cockeyed insert sheets which in effect ruins the insert sheet memorabilia display. This is because the insert sheets are not initially aligned parallel with the edges of the plastic envelope, or even if initially aligned, become misaligned during handling just before insertion into the laminator. This problem is aggrevated when laminating more than one insert and/or laminating a two-sided display in a manner to be described.

SUMMARY OF A PREFERRED EMBODIMENT OF THE INVENTION

The aforesaid needs and objects of the present invention, being an integral part thereof, are met by providing a paper memorabilia support sheet having a light transmissive plastic cover sheet affixed thereto, the support sheet having rows and columns of imprinted adhesive zones made of readily releasable and reusable pressure sensitive self-stick adhesive. The aforesaid insert sheets of memorabilia are manually positioned upon the front surface of the support sheet and are held to the support sheet by the self-stick adhesive zones imprinted thereon. Preferrably, the adhesive zones are readily visible so that they act as visual fiducials and thus aid in aligning the insert sheets parallel with respect to the edges of the plastic envelope.

Even when carefully positioning the inserts upon the paper support sheet, the user will often unintentionally position an insert sheet ina skewed unaesthetic manner. If one or more or the insert sheets are mounted skewed with respect to the envelope edges, the unskilled user may easily peel away the inserts from the support sheet and re-position them one or even several times until the edges of the inserts are parallel with the edges of the support sheet. This is because the self-stick adhesive is reusable and the areas occupied by these adhesive zones are small relative to the total non-stick area of the front surface of the support sheet, enabling the insert sheets to easily peeled away from the support sheet. The cover sheet has a heat or pressure sensitive adhesive surface for thereafter laminating the cover sheet to the support sheet, thus encapsulating the aligned inserts between the support sheet and the cover sheet.

The self-stick adhesive zones may optionally be imprinted on the rear face of the support sheet in addition to its front face, and a second cover sheet, affixed to the support sheet, is used to laminate a second set of insert sheets to the rear of the support sheet, resulting in a two-sided display. Where heat lamination is employed, a special visual fiducial forming ink may be mixed with the self-stick adhesive of the adhesive zones, which ink disappears under the influence of the heat of lamination. Also, in the absence of the aforesaid self-stick adhesive zones, the inserts, even if initially positioned upon the support sheet in a non-skewed manner, can often shift and become skewed during handling, before lamination is completed. this undersirable shifting is even more likely for the two-sided laminated display or photo ID card having insert sheets on both sides of the support or core sheet.

BRIEF DESCRIPTION OF THE DRAWINGS

Other objects, features and advantages of the present invention will become apparent upon reading the following specific description, taken in conjunction with the drawings in which.

SPECIFIC DESCRIPTION OF PREFERRED EMBODIMENTS OF THE INVENTION

Figure 1:
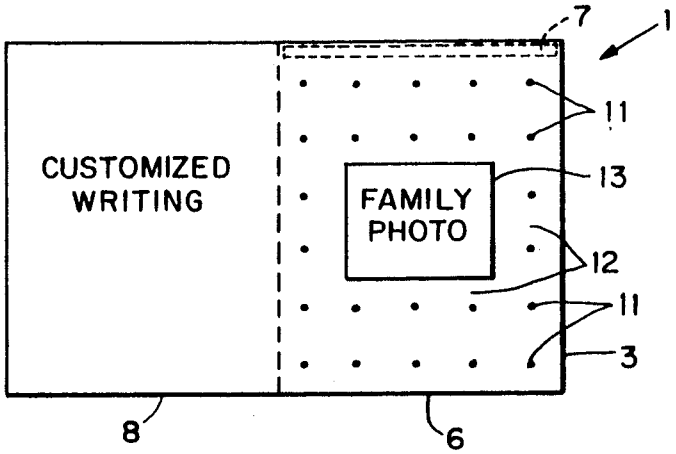
FIG. 1, illustrates a greeting card having a single customized family photo laminated within a greeting card.
Figure 2:
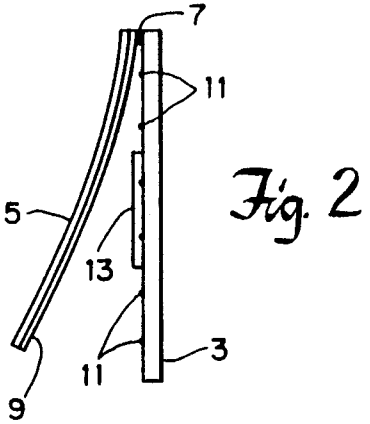
FIG. 2, illustrates a side view of the embodiment of FIG. 1.

In FIGS. 1 and 2, a greeting card 1 has a paper insert memorabilia support sheet 3 and a plastic cover sheet 5 having a cover sheet adhesive layer 9 thereon facing the support sheet 3. The plastic cover sheet is preferrably made of poly-ethylene terephthalate, commonly used for plastic laminations and marketed under carious trademarks e.g. "Mylar", "Melanex", etc. Adhesive layer 9 could comprise heat activatable polyolefin if lamination is to be carried out by heat and pressure, or could be of the pressure sensitive variety. The cover sheet 5 with its heat seal 9 is affixed to an upper edge portion of support sheet 3 by a heat seal 7, or by a pressue sensitive adhesive.

In accordance with the invention, rows and columns of self-stick adhesive zones 11, are imprinted upon the insert sheet support sheet 3 as shown in FIGS. 1 and 2. These adhesives zones comprise readily releasable, reusable pressure sensitive self-stick adhesive, widely in use in connection with self-stick remainder notes such as those marketed under the trademark "Post-it" note pads, and distributed by 3M Corporation. Adhesive zones 11 are preferrably small dots, so that the total area occupied by the adhesive zones is small, that is two to twenty percent of the area of the face of the support sheet having the zones thereon. This provides substantial border areas 12 between the adhesive zones 11 to provide for good bonding of the cover sheet 5 to the support sheet in margins surrounding the inserts.

In FIGS. 1 and 2, plastic cover sheet 5 overlays the right hand half 6 of sheet 3 of the card supplied to the user. An insert sheet 13 such as a family photo, sketch or other customized material is positioned by the user upon the support sheet 3 and is held thereon by the self-stick adhesive zones or dots 11 pre-printed upon the card at the factory. If the unskilled user is lucky, the edges of the photo 13 will be aligned with or parallel with respect to the edges of the support sheet 3 after being affixed thereto. If the photo is cockeyed or skewed with respect to the support sheet edges, the photo is readily lifted or peeled off of the support sheet by the fingers of the unskilled user, since most of the support sheet surface has no adhesive thereon. In other words, because the adhesive zones 11 are small, there will be substantial separations between the poorly mounted insert sheet and the support sheet surface, to make it easy to manually peel the photo insert sheet 13 off of the support sheet.

However, even if alignment of the photo edges with respect to the insert sheet edges is attained on the first try, the borders surrounding the photo may have uneven widths, so that the photo should be peeled off of the support sheet and repositioned. Importantly, the adhesive bond is weak and thus readily releasable, permitting easy removal of the insert sheet or sheets. The adhesive in the zones is also reusable, enabling the unskilled user to make several tries for correct positioning and alignment. The home user or store clerk now passes the right-hand portion 6 of the card through the laminator to create an attractive display of the photo or sketch, and the user can right a customized message on the left-hand portion 8 before mailing the now customized greeting card.

The invention may be practised with adhesive zones having virtually no visible contrast with the support sheet, since the user can reference by "eyeballing" the insert sheet edges parallel with respect to the envelope edges. The user can repeatedly reposition the inserts as the adhesive is re-usable. However, it is preferrable to produce a visual contrast between the support sheet 3 and the adhesive zones 11 so that the rows and columns of adhesive zones, which are parallel to the envelope edges, act as visible fiducials closer to the inserts. Furthermore, the fiducials are preferrably small, so that the adhesive dot fiducials upon the support sheet surface portions surrounding the borders of the inserts will not be too visually pronounced, to produce a somewhat unaesthetic effect. The fiducials could be light pink or blue on a white support sheet surface to yield this result.

In accordance with a further feature of the invention, a special ink can be mixed with the adhesive material of the adhesive zones which ink disappears upon the application of heat to the envelope during laminating step. Alternatively, the special ink may be printed within a central portion of the adhesive zones 11. For a description of the nature and composition of such ink, see U.S. Pat. No. 4,188,139 issued to Pasini. The optional use of this special ink can provide enhanced visual contrast between the adhesive zone dots and the support sheet surface, which can be particularly helpful in poor lighting conditins or in aid of people having limited eyesight.

Another option is to use standard ultra violet ink and align the items under an ultra violet lamp, which is widely used in security applications. In such a case, the u.v. dots are a permanent part of the final laminated display. They are also invisible under normal ambient light but are a protection against tampering because the geometric pattern would be distorted and show up as irregular or missing dots under u.v. examination. However, in the interest of economy, the self-stick adhesive used in "Post-it" pads can be used without adding a contrast enhancing ink, since the limited visual contrast of the fiducials with respect tothe background may be sufficient for many users.

Another possibility is to print the fiducials with a light blue or pink ink, and imprint the self-stick adhesive within a smaller central portion of the inked fiducials. This approach will not present any printing alignment problems. Also the printing of the preferred continuous "wall-paper" pattern of rows and columns of adhesive zone dot fiducials will not involve printing registration problems during the manufacture of the card supplied to the user, so long as the rows and columns of fiducial dots are parallel to the edges of the plastic envelope.

Figure 3:
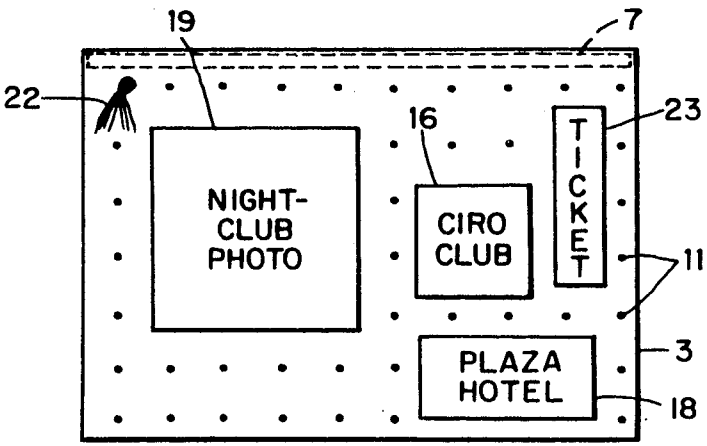
FIGS. 3 and 4 illustrate the mounting of a plurality of inserts of memorabilia upon both sides of the paper core sheet, for creating two groups of items to be laminated.
Figure 4:
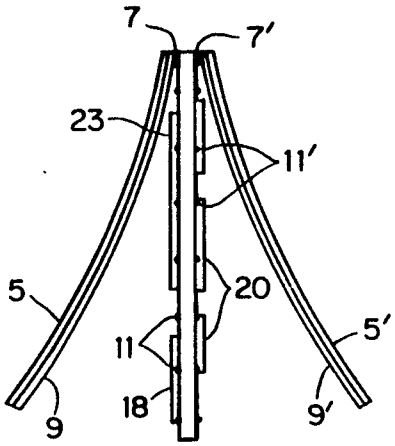

In FIGS. 3 and 4, a dual-sided envelope is shown with several insert sheets of memorabilia mounted on the front and rear faces of the insert sheet support sheet 3 before lamination. The support sheet now becomes a core sheet since it will occupy the central portion of the laminated product. A second light transmissive laminatable cover plastic cover sheet 5' with its heat activatable layer 9' facing the rear face of the core sheet 3 is shown. A second heat seal 7' affixes the rear second cover sheet 5' to the core sheet upon manufacture. The front face of the core sheet 3 bears the "wallpaper" pattern of rows and columns of adhesive dot fiducials 11 as previously described. A second set of like fiducials 11' are printed on the rear surface of the core sheet 3. Thus a second set of inserts can be neatly mounted upon and laminated to the rear of the core sheet and the insert capacity of the visual display is thus doubled.

An exemplary pictorial composition or montage of laminated inserts could, for example, include matchbook covers 16 and 18, photo 19 of a dating couple and insert sheet 23 could be a theater ticket, reminescent of a nostalgic event. Even a lock o hair 22 may be added to the laminated display. Thus, the product could have much versitility. People could bring their memorabilia to a shopping mall and the lamination could be produced by an unskilled store clerk. A second group of insert sheet memorabilia 20 may be mounted on the rear face of the support sheet 3 by means of adhesive zones 11' before lamination to produce a double sided display of more memorabilia. The display could be suspended from the ceiling in the home in the manner of a mobile so that both sides may be viewed simultaneously. Alternatively, the double-sided display could be wall mounted to display one side and could be turned around from time to time to display the other side. This method is also useful for making photo ID cards having inserts on both sides of the core sheet 3.

In the case of the greeting card of FIG. 1, an inexpensive heat and pressure laminator could be provided in the vicinity of the greeting card counter. Such laminators have been widely marketed by Avant Inc. of West Concord, Ma and produce more aesthetic laminations than those produced by pressure sensitive adhesives. In the latter case, a soft rubber squeege roller may produce an acceptable lamination by a pressure sensitive adhesive, covered by a conventional protective overlay sheet which is manually peeled away by the user before application of the squeege roller. We still prefer heat and pressure lamination by means of a conventional laminator, where the cover sheet is of a structured plastic of polyester and polyethylene, the structured plastic sheet having a thickness of 1.5–3 mils. However, such lamination could be carried out by the user applying an ordinary kitchen iron to the plastic cover sheet at the cost of producing a product of somewhat lower quality. The embodiments of FIGS. 3 and 4 may be laminated in like manner to produce the final laminated product.

While preferred embodiments of the present invention have been described above, other embodiments will be apparent to those skilled in the art, and thus the scope of the present invention is to be limited solely by the terms of the following claims and art recognized equivalents thereof. The invention may also be used to make multiple insert ID cards, or virtually any other display product.

What is claimed is:

1. A laminatable envelope comprising:

(a) an insert sheet support sheet having a light transmissive cover sheet affixed to said support sheet, said light transmissive cover sheet having a cover sheet adhesive upon major portions thereof and facing a front face of said support sheet;

(b) a plurality of insert sheet alignment assisting adhesive zones positioned upon said support sheet comprising readily releasable and reusable pressure sensitive self-stick adhesive, the total area occupied by said adhesive zones being small relative to the area of the front face of said support sheet to facilitate easy removal and realignment of misaligned insert sheets mounted upon the front surface of said support sheet while also providing bonding areas between said adhesive zones, enabling said cover sheet adhesive to bond said cover sheet to the bonding areas upon the front face of said support sheet.

2. The envelope of claim 1 wherein said light transmissive cover sheet is made of heat activatable structured plastic having a thickness of about 1.5–3 mils and said support sheet is made of thicker paper.

3. The envelope of claim 1 wherein said cover sheet adhesive is heat activatable and said adhesive zones include an ink therein which disappears upon the application of heat thereto during lamination of said cover sheet to said core sheet.

4. The envelope of claim 3 wherein said light transmissive cover sheet is made of heat activatable structured plastic having a thickness of about 1.5–3 mils and said support sheet is made of thicker paper.

5. The envelope of claim 1 wherein said adhesive zones form a two-dimensional array pattern of rows and columns of adhesive zones.

6. The envelope of claim 5 wherein said cover sheet adhesive is heat activatable and said adhesive zones include an ink therein which disappears upon the application of heat thereto during lamination of said cover sheet to said core sheet.

7. The envelope of claim 6 wherein said light transmissive cover sheet is made of heat activatable structured plastic having a thickness of about 1.5–3 mils and said support sheet is made of thicker paper.

8. The envelope of claim 5 wherein said light transmissive cover sheet is made of heat activatable structured plastic having a thickness of about 1.5–3 mils and said support sheet is made of thicker paper.

9. The envelope of claim 1 wherein said adhesive zones have a color which provides visual contrast to the color of said support sheet.

10. A laminatable envelope comprising:

(a) a core sheet having a first light transmissive cover sheet affixed to said core sheet, said first light transmissive cover sheet having a cover sheet adhesive upon major portions thereof and facing a front face of said core sheet;

(b) a second light transmissive cover sheet affixed to said core sheet, said second light transmissive cover sheet having a cover sheet adhesive upon major portions thereof and facing a rear face of said core sheet;

(c) a plurality of insert sheet alignment assisting adhesive zones positioned upon the front face and the rear face of said core sheet, said adhesive zones comprising readily releasable and reusable pressure sensitive self-stick adhesive, the total area occupied by said adhesive zones being small relative to the area of the front and rear face of said core sheet to facilitate easy removal and realignment of misaligned insert sheet mounted upon the front and rear faces of said core sheet while also providing bonding areas between said adhesive zones enabling said adhesive to subsequently bond said cover sheet to the bonding areas upon the front face of said core sheet.

11. The envelope of claim 10 wherein said light transmissive cover sheet is made of heat activatable structured plastic having a thickness of about 1.5–3 mils and said core sheet is made of thicker paper.

12. The envelope of claim 10 wherein said cover sheet adhesive is heat activatable and said adhesive zones include an ink therein which disappears upon the application of heat thereto during lamination of said cover sheet to said core sheet.

13. The envelope of claim 12 wherein said light transmissive cover sheet is made of heat activatable structured plastic having a thickness of about 1.5–3 mils and said core sheet is made of thicker paper.

14. The envelope of claim 10 wherein said adhesive zones form a two-dimensional array pattern of rows and columns of adhesive zones oriented parallel with respect to the envelope edges.

15. The envelope of claim 14 wherein said cover sheet adhesive is heat activatable and said adhesive zones include an ink therein which disappears upon the application of heat thereto during lamination of said cover sheet to said core sheet.

16. The envelope of claim 15 wherein said light transmissive cover sheet is made of heat activatable structured plastic having a thickness of about 1.5–3 mils and said core sheet is made of thicker paper.

17. The envelope of claim 14 wherein said light transmissive cover sheet is made of heat activatable structured plastic having a thickness of about 1.5–3 mils and said core sheet is made of thicker paper.

18. The envelope of claim 10 wherein said adhesive zones have a color which provides visual contrast to the color of said core sheet.

19. A method of making a lamination of at least one insert sheet comprising the steps of:

(a) providing an insert sheet support sheet having a plurality on insert sheet alignment assisting adhesive zones upon a support surface thereof, said adhesive zones including readily releasable and reusable pressure sensitive self-stick adhesive, the total area occupied by said adhesive zones being small relative to the area of the support surface of said insert support sheet to facilitate easy removal and realignment of misaligned insert sheets mounted upon the support surface of said support sheet while also providing bonding areas between said adhesive zones;

(b) pressing one or more insert sheets against said adhesive zones to mount said insert sheets upon said support sheet; and (c) thereafter laminating a light transmissive cover sheet to said support sheet.

20. The method of claim 19 wherein said cover sheet has a heat activatable adhesive thereon and step (c) is performed by applying heat and pressure to said cover sheet.

21. The method of claim 20 wherein step (c) is performed by passing a kitchen iron over said cover sheet.

22. The method of claim 19 wherein an ultra violet ink is included within said adhesive zones and further including the step of illuminating said insert sheet support sheet with ultra violet light before the performance of step (b).

23. A method of making a lamination of at least one insert sheet comprising the steps of:

(a) providing an envelope having a light transmissive cover sheet affixed to a minor portion of an insert sheet support sheet, said support sheet having a plurality of insert sheet alignment assisting adhesive zones upon a support surface thereof, said adhesive zones including readily releasable and reusable pressure sensitive self-stick adhesive, the total area occupied by said adhesive zones being small relative to the area of the support surface of said support sheet to facilitate easy removal and realignment of misaligned insert sheets mounted upon the support surface of said support sheet while also providing bonding areas between said adhesive zones;

(b) pressing said insert sheet(s) against said adhesive zones to mount said insert sheets upon said support sheet;

(c) repeating step (b) upon misalignment on an insert sheet with respect to edge portions of said light transmissive cover sheet until said misalignment is eliminated; and (d) thereafter laminating said light transmissive cover sheet to said support sheet.

24. The method of claim 23 wherein an ultra violet ink is included within said adhesive zones and further including the step of illimunating said insert sheet support sheet with ultra violet light before the performance of step (b).

25. The method of claim 23 wherein said cover sheet has a heat activatable adhesive thereon facing said support sheet and step (c) is performed by applying heat and pressure to said cover sheet.

26. The method of claim 25 wherein step (c) is performed by passing a kitchen iron over said cover sheet.

* * * * *